United States Patent [19]

Cordier et al.

[11] Patent Number: 4,775,392

[45] Date of Patent: Oct. 4, 1988

[54] COAL GASIFICATION INSTALLATION

[75] Inventors: Jean Cordier, Saint-Saulve; Marcel Lemaire, Gif-sur-Yvette, both of France

[73] Assignee: Union Siderurgique du Nord et de L'Est de la France (USINOR), Puteaux, France

[21] Appl. No.: 33,886

[22] Filed: Apr. 2, 1987

Related U.S. Application Data

[63] Continuation of Ser. No. 703,957, Feb. 21, 1985, abandoned.

[30] Foreign Application Priority Data

Feb. 23, 1984 [FR] France ..... 84 02770

[51] Int. Cl.[4] ..... C10J 3/57

[52] U.S. Cl. ..... 48/92; 48/86 R; 48/128; 266/138; 266/155

[58] Field of Search ..... 48/92, 128, 86 R; 266/138, 155, 157; 122/7 R

[56] References Cited

U.S. PATENT DOCUMENTS

| | | | |
|---|---|---|---|
| 2,681,121 | 6/1959 | Richardson | 266/157 |
| 3,173,489 | 3/1965 | Okaniwa et al. | 266/157 |
| 3,177,065 | 4/1965 | Okaniwa et al. | 266/157 |

FOREIGN PATENT DOCUMENTS

| | | | |
|---|---|---|---|
| 2286873 | 9/1975 | France . | |
| 2299395 | 1/1976 | France . | |
| 1287724 | 1/1969 | Fed. Rep. of Germany . | |
| 2521080 | 11/1975 | Fed. Rep. of Germany | 48/92 |
| 2123435 | 6/1983 | United Kingdom . | |

*Primary Examiner*—Peter Kratz

*Attorney, Agent, or Firm*—Cushman, Darby & Cushman

[57] ABSTRACT

The installation comprises mainly a reactor (1) for the gasification of powdered coal on a bath (2) of liquid iron, a cooling flue (9) constituting a boiler connecting the outlet of the reactor (1) to a vapor superheater (11) fed with vapor (26) issuing from the boiler, a dust-removing cyclone (13) connected to the outlet of the superheater (11), a thermal exchanger (14) connected to the outlet of the cyclone (13) in which a drying fluid (31, 32)is heated by thermal exchange with the combustible gas, a conditioning tower (16) connected to the outlet of the thermal exchanger, the conditioning tower being connected to a dry electrofilter (17) which feeds a storage gasometer (20) through a three-way valve (21). The heated drying fluid (32) and the vapor (28,30) issuing from the superheater (11) are employed in the installation for preparing and conveying the fuel and the comburent fed to the reactor.

7 Claims, 2 Drawing Sheets

COAL GASIFICATION INSTALLATION

This is a continuation of application Ser. No. 703,957, filed Feb. 21, 1985, which was abandoned upon the filing hereof.

BACKGROUND OF THE INVENTION

1. Field of the Invention

The present invention relates to an installation for the gasification of coal, more particularly of the type employing a gasification method employing a bath of liquid metal.

2. Description of the Prior Art

The method of gasification of coal employing a bath of liquid iron is already known and permits the production of a gas which is rich in CO and $H_2$ with low contents of $CO_2$. However, the gas has contents of residual S which should be limited as far as possible for the various envisaged applications, and in particular for the use of the gas as a raw material in chemical synthesis, for example for producing methanol and ammonia.

An object of the present invention is to provide an installation for producing a synthesis gas of high quality with a good yield from the use of coal.

SUMMARY OF THE INVENTION

The invention therefore provides an installation for the gasification of a solid powdered fuel of the type comprising a gasification reactor employing a bath of liquid metal and provided with at least one nozzle for introducing therein the solid powdered fuel and a comburent gas, and a discharge orifice for the gases produced, characterized in that it comprises the following element disposed in series relation, starting at the discharge orifice of the reactor and traversed in series by the gases issuing from the reactor: a flue constituting a boiler, a vapour superheater fed by said boiler, a dust remover, a thermal exchanger for heating a drying fluid, a conditioning tower, a filtering device and a gas storing device, the vapour supplied by the superheater and the drying fluid issuing from the heater being employed in the installation in particular for the preparation and the supply of the fuel and the comburent fed to the reactor.

The invention will be described hereinafter with reference to the accompanying drawing, which shows merely an embodiment of the invention.

DETAILED DESCRIPTION OF THE INVENTION

Figure 1:
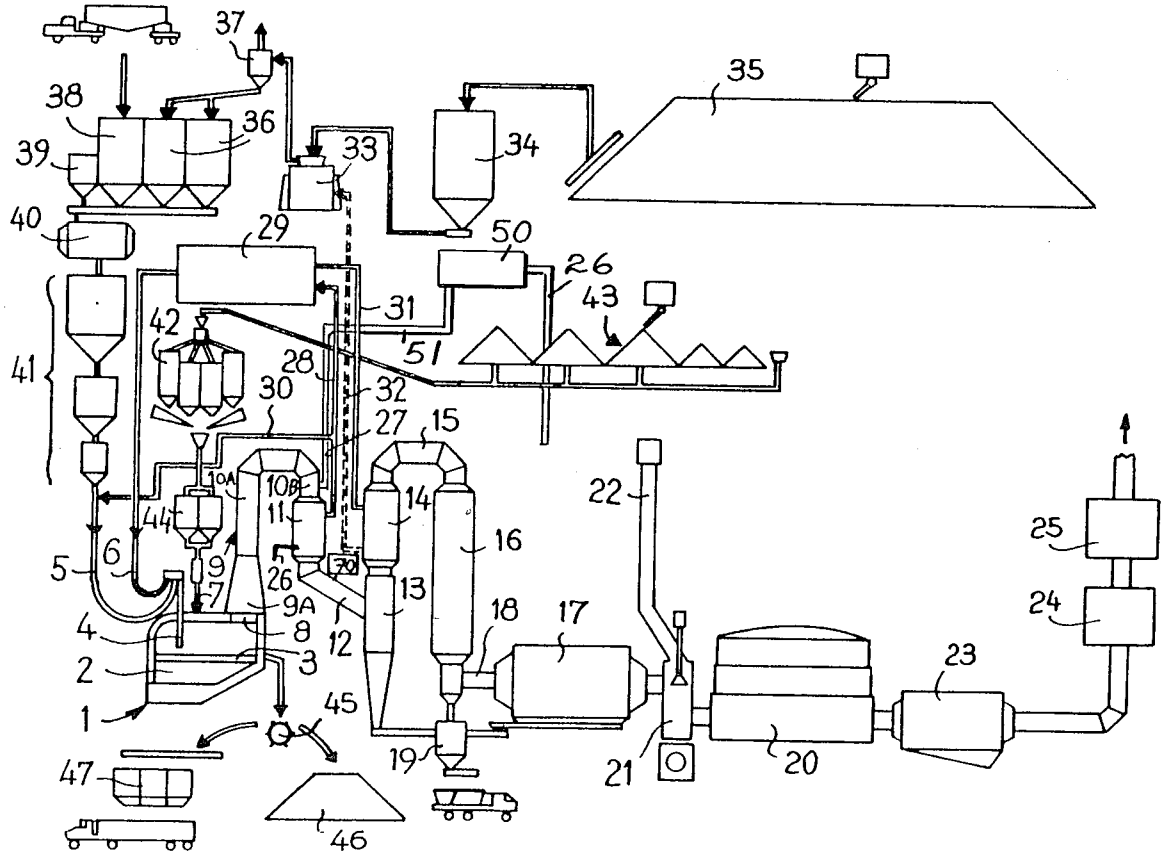
FIG. 1 diagrammatically represents the gasification installation according to the present invention.
Figure 2:
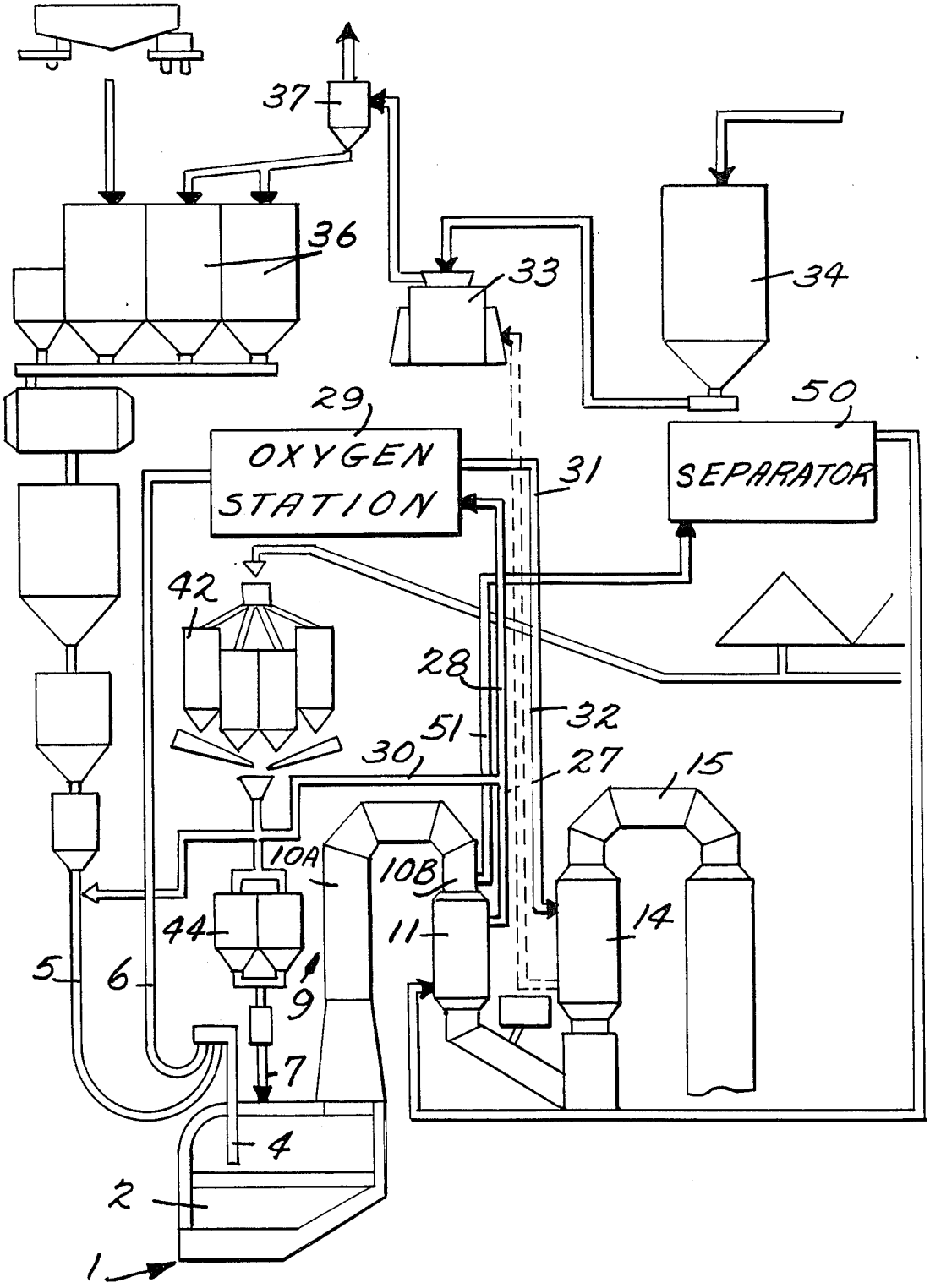
FIG. 2 diagrammaticall represents on an enlarged scale details of a part of the installation shown in FIG. 1.

This installation comprises a coal gasification reactor 1 which is the subject of another U.S. patent application Ser. No. 703,658 filed on Feb. 21, 1985, now U.S. Pat. No. 4,649,867. This reactor 1, shown diagrammatically is section, is of the type having a bath 2 of liquid iron, this bath being surmounted by a layer of slag 3. The powdered coal is injected with a flux containing lime and desulphurizing additives in the bath of cast iron by means of a nozzle 4 connected to a conduit 5. This nozzle 4 is combined with a structure comprising cooled multiple walls (not shown) and also serves to inject oxygen to which vapour is added and which is supplied through a conduit 6. The reactor 1 is also provided in its upper part with a conduit 7 for introducing rock addition elements.

The reactor 1 is of the non-tilting type but is movable in translation and is of large size. Indeed, owing to slideways on which the reactor is mounted, a new reactor can be substituted for a worn reactor so that the time during which the gasification installation is stopped for repairing the reactor is reduced to a minimum. The reactor 1 is also provided with draining means for renewing the metal which may have been polluted by the non-volatile alloy metals or for draining it before moving the reactor in translation.

The gases produced in the reactor 1 are discharged by way of an orifice 8 communicating with a flue 9 for cooling gases (described hereinafter) in the direction of flow of the gases. This flue 9 comprises first of all a high-pressure boiler 9A which is of the direct radiation type and has a conical shape constituting a hood over the orifice 8, then a rising conduit or duct 10A and a descending conduit or duct 10B which have a double wall (shown in dotted lines) and which connect the boiler 9A to a vapour superheater 11. The gases issuing from the reactor 1 thus pass through the flue 9 formed by the three aforementioned sections in which they are cooled before entering the vapour superheater. The sections 10A and 10B of the flue also act as a water boiler owing to a circulation of water in the double wall or jacket. The water circulating in the boiler 9A and the jackets of the conduits 10A and 10B is sent to a conventional separator 50 through a conduit 51.

After having passed through the superheater 11, the combustible gases are conducted through a duct 12 to one or more dust-removing cyclone(s) 13. The dedusted gases issuing from the cyclone(s) 13 pass through a thermal exchanger 14 and are then conveyed through a conduit 15 to a conditioning tower 16 into which a mist of water in injected. In this conditioning tower, the gases are humidified and cooled in a counter-current manner with a descending mist of water and extracted at the base of the tower so as to be conveyed to a dry electrofilter 17 through a conduit 18. The dust recovered in the cyclone 13, the conditioning tower 16 and the dry electrofilter 17 is stored in a discharge hopper 19. The cleaned combustible gases issuing from the electrofilter 17 are conveyed, after saturation by spraying water (not shown), in a sleeve disposed at the outlet of the electrofilter, to a gasometer 20 through a three-way valve 21 which makes it possible to convey the gases rapidly to a flare 22.

The combustible gases stored in the gasometer 20 of the wet type can thereafter undergo an additional treatment which consists in an additional cleaning of the gases in a wet electrofilter 23, then a compression in a compressor 24 and, optionally, a final complete de-sulphurizing treatment at 25.

The vapour separated out in the separator is conveyed through a conduit 26 to the base of the superheater 11 from which it is extracted through a conduit 27. The vapour issuing from this conduit 27 is conveyed, on one hand, through a conduit 28, to a compressor (not shown) of the oxygen station 29 the compressor of which it drives and, on the other hand, through a conduit 30, to the conduit 5 where it acts as a conveying fluid for the powdered coal fed to the nozzle 4. The oxygen station 29 supplies the nozzle with oxygen through the conduit 6 and moreover supplies nitrogen employed as a drying fluid and conveyed through a conduit 32 to a coal crusher-drier 33.

This crusher-drier is fed with coal to be converted into power by a hopper 34 which is supplied with raw coal from a homogenized storage of this coal 35. The dry powdered coal issuing from the crusher-drier 33 is conveyed through a cyclone 37 to intermediate storage hoppers 36.

Powdered lime is also stored in a hopper 38 together with addition elements such as Mn ore, dolomite, and, optionally, furnace dust containing zinc in a hopper 39. The hoppers 36, 38, 39 constitute a supply battery of a mixer 40 which feeds intermediate bins 41 for weighing and regulating the supply of powdered coal conveyed in the conduit 5.

A battery 42 of hoppers containing various addition elements comprising rocks, flux and scrap-iron coming from a corresponding store 43, feeds weighing bins 44 which discharge into the conduit 7 supplying rock addition elements.

The slag of the layer 3 surmounting the bath of iron 2 is granulated in a granulator 45 and stored at 46 or discharged at 47 to the point of its final utilization, for example as cement clinker.

One of the important features of the present invention resides in the design of the various component parts whereby it is possible to obtain a suitable thermal cycle of cooling of the combustible gases produced in the reactor 1 by gasification of the coal.

Indeed, in order to achieve a suitable de-sulphurization of the gases produced in the reactor 1, the gases must be maintained at predetermined temperature levels and during predetermined periods.

The de-sulphurization is achieved during the cooling of the gases in the flue 9 and as far as the thermal exhanger 14 before the elimination by coalescence of the aerosols of metal oxysulphides and sulphides in the conditioning tower 16.

The de-sulphurization is achieved by an action on the gas produced, in particular by a gasification of coal, by vapours in the form of aerosols of iron and/or manganese and/or zinc and/or their oxides according to a process disclosed in another U.S. patent application Ser. No. 703,659 filed Feb. 21, 1985 by the applicant and now continuation application Ser. No. 051,152 filed May 15, 1987.

This de-sulphurization under the effect of iron vapours issuing from the bath of iron and possibly vapours of manganese introduced in the form of addition elements by the nozzle 4 or the conduit 7, takes place throughout the evolution of the temperature profile between the free internal volume of the reactor 1 and the conditioning tower 16 for the gas.

An intense complementary de-sulphurization with zinc may be carried out by the injection of Zn vapours in the form of aerosols in the produced gas at a point preferably located on the duct 12 between the outlet of the superheater 11 and the cyclone 13. The devices for injecting Zn vapour in the form of aerosols are diagrammatically represented by the reference numeral 70 in the FIG. 1.

By way of a non-limiting example, the gases issue from the reactor at a temperature of about 1,500° C. and are first of all cooled to about 1,450° C. at the outlet of the boiler 9A, and then to about 730°–750° C. at the inlet of the superheater 11. In the latter, the vapour issuing from the separating vessel is superheated to about 400° C. and discharged through the conduit 27.

At the outlet of the superheater 11, the gases are returned to the temperature of about 620° C. and then cooled to about 600° C. at the outlet of the cyclone(s) 13. The gases issue from the exchanger 14 at a temperature of about 380° C. after having raised the drying fluid (which is nitrogen) taken from the conduit 31, to a temperature of about 355°–360° C.

The gases are then treated in the conditioning tower 16 with a mist of water and extracted at the base of the tower at about 150° C., and then conveyed at this temperature to the dry electrofilter 17 at the outlet of which they are cooled to about 55° C. by saturation with water before being sent to the gasometer 20.

The periods of stay of the gases produced in the reactor 1 in the various elements constituting the cooling circuit for the purpose of their de-sulphurization, are the following, which are given merely by way of a non-limiting example:

- 1½ seconds at high temperature (>1,200° C.) in the reactor, the boiler 9A forming the hood and the first conduit 10A where the de-sulphurization is achieved with Mn vapours;
- ½ second at medium temperature (>750° C.) in the second conduit 10B where the de-sulphurizations with iron vapours are achieved (in the absence of Mn);
- 2 seconds at low temperature (600<t<750° C.) in the superheater 11 and in the cyclone(s) 13 where the intensive de-sulphurization is effected with Mn and possibly Zn (when the Zn is introduced on the downstream side of the superheater 11);
- 1½ seconds at a very low temperature (350<t<600° C.) in the nitrogen exchanger 14 where the final de-sulphurization with zinc results in a relatively dry gas with a very low sulphur content, reaching before the conditioning tower where the gas is humidified for about 7 seconds between 350° and 150° C. where the de-sulphurization and the coalescence of the aerosols of metal oxysulphides and sulphides are completed.

What is claimed is:

1. An installation for the gasification of powdered solid fuel, comprising a gasification reactor containing a liquide metal bath, at least one nozzle extending into the reactor for introducing the powdered solid fuel and a comburent gas into the reactor, means defining an outlet orifice in the reactor for discharging the gases produced in the reactor, said installation further comprising the following elements, disposed in series relation, communicating with one another so as to form a continuous passageway, starting at said outlet orifice and traversed one after the other by the gases issuing from the reactor: a gas flue having at least a part constituting a water boiler, a vapour superheater having a superheated vapour outlet, a dust remover, a thermal exchanger for heating a drying fluid and having a drying fluid inlet and a dried fluid outlet, a conditioning tower, a filtering device and a storage device for the gas communicating with the filtering device, the installation further comprising a water vapour separator connecting said boiler to the superheater so as to supply water vapour to the superheater means for preparing and supplying the solid fuel, compressor means for feeding the comburent gas, means for supplying said drying fluid, a first conduit connecting said means for preparing and supplying said solid fuel to said nozzle, a second conduit connecting the superheated vapour outlet of the superheater to said first conduit, a third conduit connecting said superheated vapour outlet of the superheater to the compressor means for driving said compressor means for feeding said comburent gas, a fourth conduit connecting said means for supplying said drying fluid to said drying fluid inlet of said thermal exchanger, a fifth conduit connecting said heated fluid outlet of the thermal exchanger to said means for preparing and supplying the fuel so as to dry the fuel, and a sixth conduit connecting said compressor means to said nozzle.

2. An installation according to claim 1, wherein the gas flue comprises, in the following order relative to the direction of flow of the gases therethrough, said water boiler in the form of a direct radiation boiler of frustoconical shape constituting a hood, a rising duct having a water jacket and a descending duct having a water jacket, said water jackets communicating with said direct radiation boiler.

3. An installation according to claim 1, comprising a duct connecting a gas outlet of the superheater to a gas inlet of the dust-remover, and means for injecting into said duct zinc vapour in the form of aerosols.

4. An installation according to claim 2, comprising a duct connecting a gas outlet of the superheater to a gas inlet of the dust-remover, and means for injecting into said duct zinc oxide vapour in the form of aerosols.

5. An installation according to claim 1, wherein said filtering device is a dry electrofilter.

6. An installation according to claim 1, wherein a three-way valve is disposed between the filtering device and the storage device.

7. An installation according to claim 1, wherein said comburent gas is oxygen and said drying fluid is nitrogen, said preparing and supplying means comprising a crusher-drier which provides a powdered raw fuel for feeding to said nozzle, said fourth conduit sending said nitrogen to the thermal exchanger and said fifth conduit sending the heated nitrogen to the crusher-drier.

* * * * *